US005149266A

United States Patent [19]

Heinemann et al.

[11] Patent Number: 5,149,266

[45] Date of Patent: Sep. 22, 1992

[54] METHOD AND APPARATUS FOR COOLING HOT MATERIAL

[75] Inventors: Otto Heinemann, Ennigerloh; Heinz-Herbert Schmits, Rheda-Wiedenbruck, both of Fed. Rep. of Germany

[73] Assignee: Krupp Polysius AG, Fed. Rep. of Germany

[21] Appl. No.: 650,735

[22] Filed: Feb. 5, 1991

[30] Foreign Application Priority Data

Feb. 13, 1990 [DE] Fed. Rep. of Germany ..... 4004393

[51] Int. Cl.[5] ..... F25B 45/00

[52] U.S. Cl. ..... 432/77; 62/63; 62/57; 110/288; 432/48

[58] Field of Search ..... 62/63, 57; 432/48, 77, 432/78; 110/288

[56] References Cited

U.S. PATENT DOCUMENTS 3,831,291 8/1974 Kayatz ..... 432/77
4,337,083 1/1982 Sweat ..... 432/77
4,422,303 12/1983 Rothenberg et al. ..... 62/63
4,457,081 7/1984 von Wedel ..... 432/77
4,621,583 11/1986 Kaski ..... 110/288
4,715,188 12/1987 Enkegaard ..... 62/63
4,762,489 8/1988 Schmidts et al. ..... 432/77
5,093,085 3/1992 Engstrom et al. ..... 432/78

FOREIGN PATENT DOCUMENTS 116763 9/1979 Japan .

*Primary Examiner*—Ronald C. Capossela
*Attorney, Agent, or Firm*—Learman & McCulloch

[57] ABSTRACT

The invention relates to the cooling of hot, layered, granular material supported on an air permeable grate through which cooling air passes constantly. Some zones of the material layer have a higher temperature than other zones. Pulses of additional cooling air are passed through the higher temperature zones at such velocity as to enhance cooling and to relayer the material at such zones. In this way the degree of recuperation of the grate cooler can be substantially improved.

17 Claims, 3 Drawing Sheets

FIG. 2a
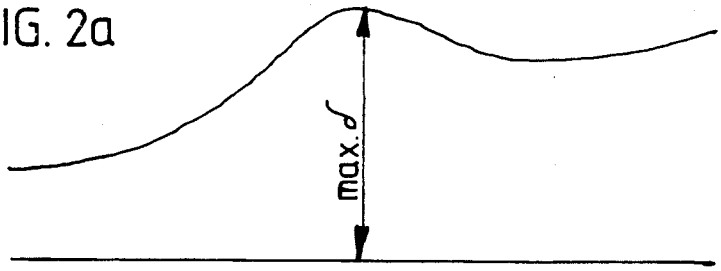
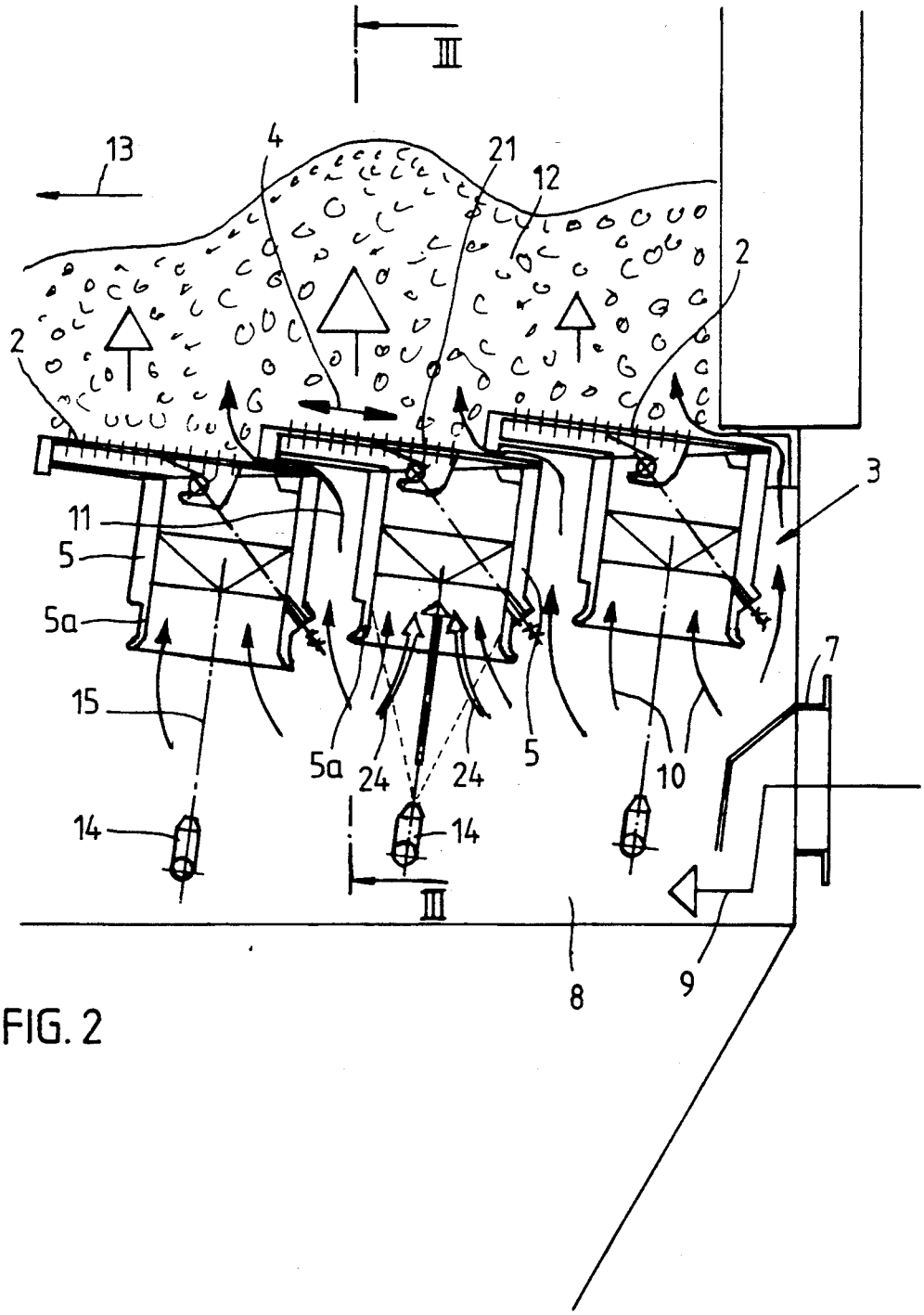
FIG. 2

METHOD AND APPARATUS FOR COOLING HOT MATERIAL

The invention relates to a method and apparatus for cooling hot granular material supported on a grate.

BACKGROUND OF THE INVENTION

In the operation of grate coolers there are frequently red (i.e. glowing hot) patches or strips on the surface of the material to be cooled, and their cause lies in insufficient cooling of these regions or zones of the layer of material to be cooled.

If the material fired in the preceding firing assembly is thrown off onto the grate cooler, then frequently the coarser pieces predominantly fall onto one side of the grate and the finer ones onto the other side. Since the air permeability of a coarse-grained bulk material is greater than that of a fine-grained material and the cooling air stream seeks the path of least resistance the finer material is frequently insufficiently cooled in the grate cooler. On the other hand, a longer time is required in order to cool the coarser pieces through to the core.

In the operation of a grate cooler care should also be taken to ensure not only that the hot material delivered should be sufficiently cooled but also that as much heat as possible should be quickly extracted from the hot material and then returned to the preceding firing apparatus via the cooling air which is thereby heated. Therefore quality of a cooler is measured in the first instance by its degree of recuperation which constitutes a measure for its heat recovery.

The object of the invention is to provide a method and apparatus for cooling granular material on an air permeable grate in such a way that a degree of recuperation is achieved which is substantially improved by comparison with the prior art and thus the cooling material discharge temperature is also lowered further.

SUMMARY OF THE INVENTION

In the method an apparatus according to the invention the zones of the layer of cooling material which have a higher temperature than the surrounding layer zones are additionally cooled by the delivery of relatively high velocity pulses of cooling air and relayered. Thus these pulsed deliveries of cooling air are superimposed on the usual cooling air stream which passes constantly through the layer at right angles to its direction of movement.

Thus on the one hand the pulsed delivery of cooling air achieves an additional cooling of particularly hot regions of the layer of material to be cooled and thus a very desirable equalisation of the temperature profile at right angles to the direction of movement of the layer. On the other hand this pulsed delivery of relatively high velocity cooling air also achieves a strongly mechanical movement of the layer regions with which it comes into contact and a resultant relayering of the particles of material located in these regions. In this way both coarse and fine material, which were more or less separated during delivery to the cooling surface, are mixed together again so that the air permeability of the layer is equalised and the cooling air stream constantly passing through the layer flows through the entire layer in a thoroughly uniform distribution.

THE DRAWINGS

FIG. 1 is a perspective view of a part of a grate cooler according to the invention, FIGS. 2 and 3 are sections along the lines II—II of FIG. 3 and III—III of FIG. 2, respectively, and FIGS. 2*a* and 3*a* are temperature profiles through the zones adjacent the sectional views according to FIGS. 2 and 3.

DETAILED DESCRIPTION

Figure 1:
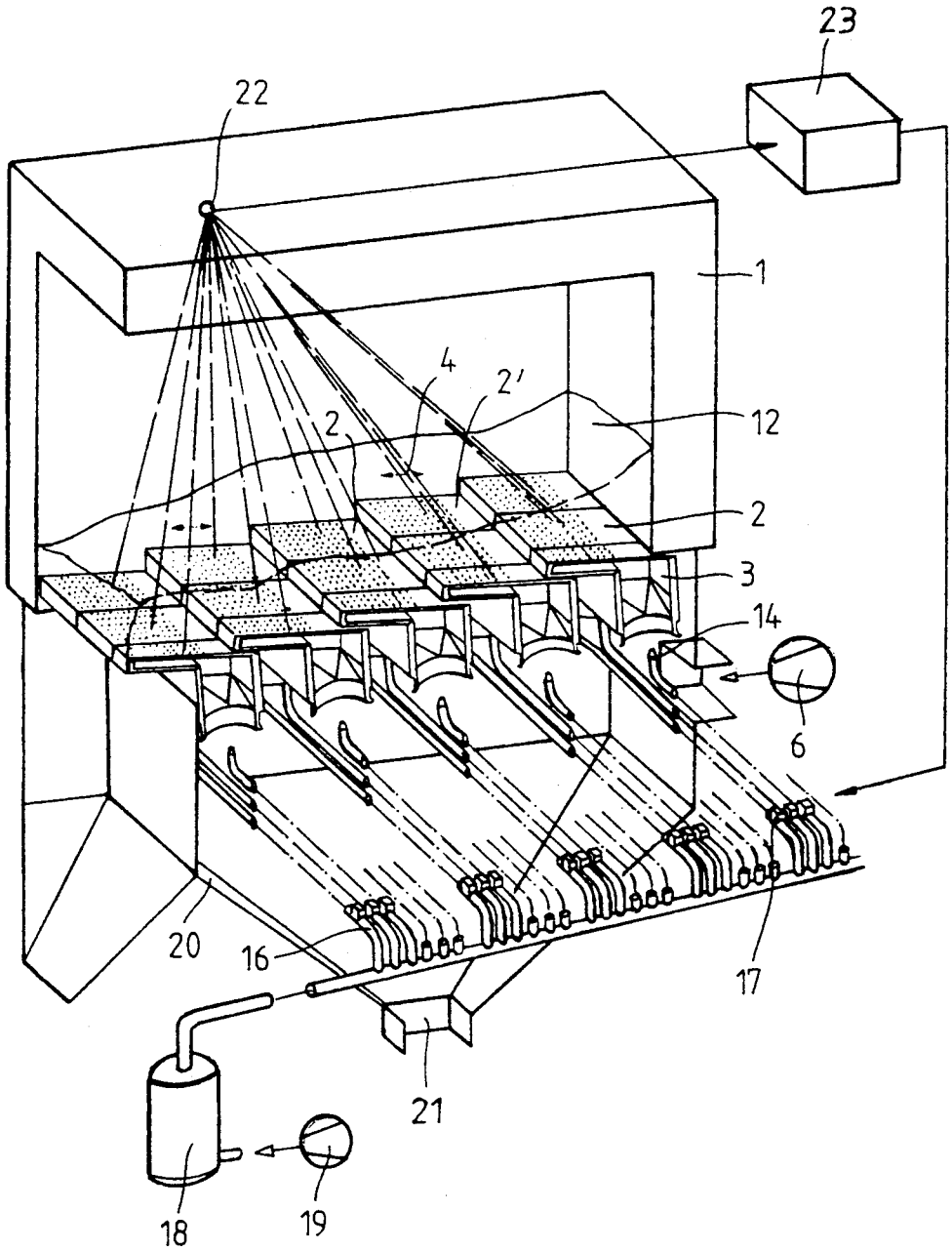
Figure 3A:
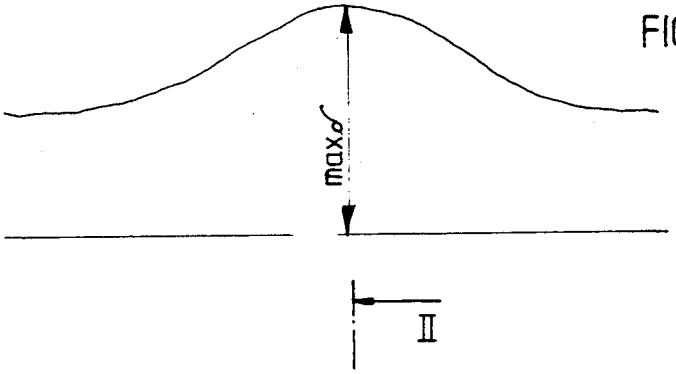
Figure 3:
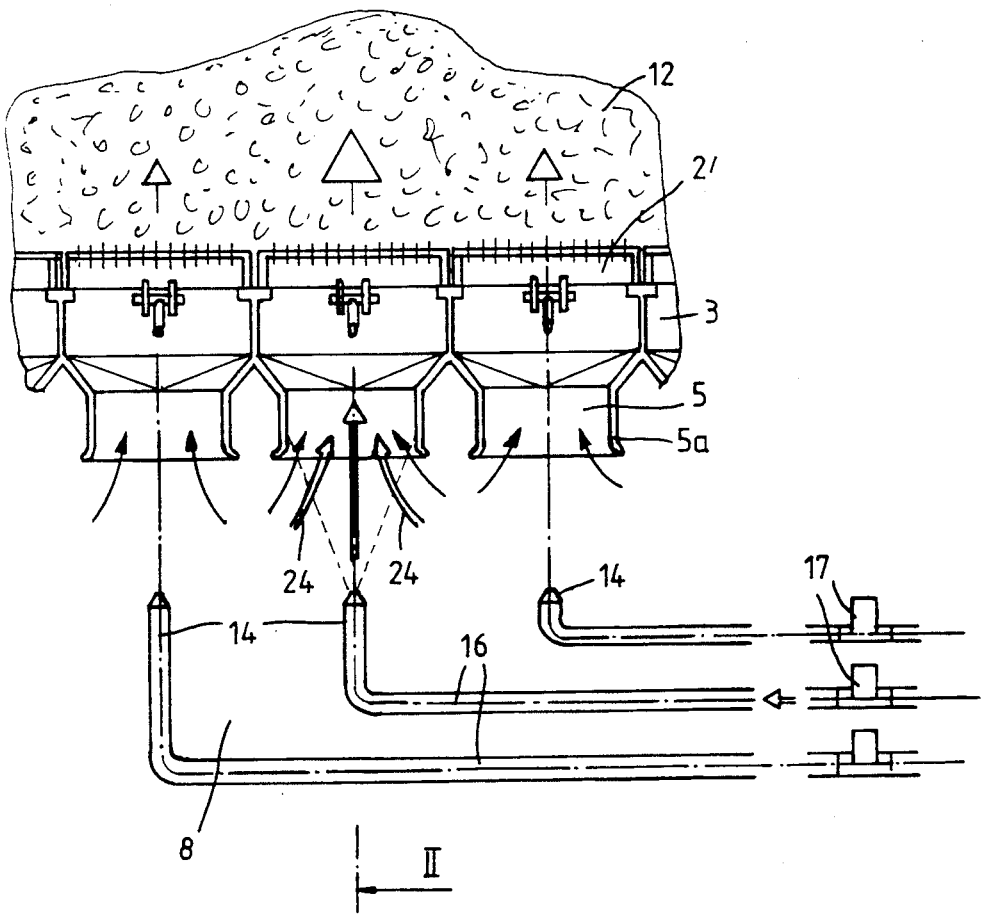

Of the grate cooler illustrated in partially cut-away view in FIGS. 1 to 3, a part of the cooler housing 1, some grate plates 2 and the grate plate carrier 3 are shown. The grate plates 2 are arranged in the form of a step grate, and here one grate plate 2' which is movable in the longitudinal direction of the arrow 4 is located in each case between two stationary grate plates 2.

For each individual grate plates 2, 2', the grate plate carrier 3 contains a box-shaped cooling air supply chamber 5 which has a nozzle-shaped inlet opening 5*a* on the underside.

The cooling air (arrow 9) which is introduced via a blower 6 through a connecting piece 7 into the air chamber 8 below the grate plate carrier 3 flows on the one hand (arrows 10) through the inlet openings 5*a*, the cooling air supply chambers 5 and the grate plates 2, 2' and on the other hand (arrows 11) between adjacent cooling air supply chambers 5 and thus also between adjacent grate plates 2, 2' into the layer of material to be cooled 12, through which it constantly passes upwards from below at right angles to the direction of movement (arrow 13).

In the illustrated embodiment nozzles 14 which are aligned axially (axis 15) with the inlet opening 5*a* of the appertaining cooling air supply chambers 5 are arranged below the cooling air supply chambers associated with the individual grate plates 2, 2'. These nozzles 14 are connected via ducts 16 with solenoid control valves 17 arranged in them to an air vessel 18 which is connected to an air compressor 19.

The air chamber 8 is closed off at the bottom by a base 20 which is provided with a discharge opening 21 for material to be cooled falling through the grate.

Known temperature sensing apparatus 22 which is only indicated schematically and by means of which the temperature prevailing at the individual zones of the surface of the layer of material to be cooled 12 can be measured or sensed is located above the grate which is formed by the grate plates 2, 2'. The apparatus 22 is connected to a computer and control unit 23 by which the solenoid valves 17 can be individually controlled.

The grate cooler functions as follows according to the invention:

The sensing apparatus 22 scans the surface of the layer of material to be cooled 12 in grid fashion as is indicated by the dash lines in FIG. 1. The size of one grate plate 2, 2' can serve for example as a grid dimension.

First all the temperatures in one row of grate plates are measured (at right angles to the transport direction—arrow 13)—and registered. Then the grate plate in this row which has the highest temperature and thus has a higher temperature than the surrounding layer zones is determined. Since the reason for the higher temperature is poorer aeration of this region of the layer, according to the invention an additional cooling and relayering takes place here. For this purpose the solenoid valve 17 associated with the grate plate in question is opened. Consequently the said hot region of the layer of material to be cooled is additionally cooled by means of a pulsed delivery of additional, relatively high velocity cooling air and is relayered.

The abrupt opening of the solenoid valve 17 allows a pulse of cooling air out of the air vessel 18 and out of the air chamber 8 through the openings in the relevant grate plate 2, 2' and into the bulk material, having the effect of immediately relayering the material at this hot zone, and the mechanical pulse is also assisted by the increase in volume of the air mass which is produced by the spontaneous heating of the cooling air stream delivered in pulses.

The described operation is then repeated in the following row of grate plates.

The grate cooler usually contains a recuperation zone (from which the cooling air is delivered, after passing through the layer of material to be cooled, to a firing assembly connected before the grate cooler) and an after-cooling zone (from which the cooling air is delivered, after passing through the layer of material to cooled, to a further heat consumer, for instance a grinding apparatus or dryer). The nozzles 14 which serve for the pulsed delivery of cooling air are advantageously provided in the entire recuperation zone (which for example occupies approximately a third of the entire grate surface).

Only a small quantity of air is required as propelling air for the nozzles, since the stream of propelled air emerging from the nozzles 14 brings with it further cooling air from the air chamber 8 (which is under excess pressure), as is indicated in FIGS. 2 and 3 by the arrows 24.

The total energy balance of the grate cooler is very favourable because of the improvement in the degree of recuperation achieved according to the invention.

FIGS. 2*a* and 3*a* show a typical temperature profile of the sections illustrated in FIGS. 2 and 3. In longitudinal section (FIGS. 2, 2*a*), i.e. in the transport direction of the grate (arrow 13), the material frequently forms a heap in the zone in which the material delivered onto the grate cooler strikes the granular mass. Consequently a high temperature occurs here (max $\delta$), so that the layer surface is preferably scanned in this strip (running at right angles to the transport direction). FIG. 3*a* shows that in this strip of high temperature—viewed at right angles to the transport direction—a maximum (max $\delta$) is again produced which is then used in the manner already explained for delivery of an additional pulse of cooling air in order to enhance cooling and cause relayering in this particularly critical region.

For applications where a localised temperature profile of the moving layer remains approximately constant over longer periods of time it is possible according to the invention to select the localised distribution of the pulsed deliveries of cooling air depending upon the localised temperature profile of the moving layer and to maintain it until the temperature profile of the moving layer has changed by a predetermined value.

Thus in many cases a rotary kiln plant is operated always with the same throughput capacity and the same speed of rotation, so that the grain size distribution in the grate cooler also does not alter significantly. In such a case it is conceivable for single or several grate plates to be acted upon simultaneously or successively with a pulse of cooling air at adjustable cycle times in order to achieve a uniform aeration of the granular mass.

The cycle control can be programmed as required independently of the place where the grate plates are installed. The energy balance is also favourable here because of the improvement in the degree of recuperation.

Finally, it is also possible after optical observation for a targeted, selective pulsed aeration to be triggered manually.

We claim:

1. A method of cooling a moving layer of hot granular material supported on an air permeable grate, said material having zones at different temperatures, said method comprising constantly passing a stream of cooling air upwardly through said grate and said material, and periodically passing pulses of additional cooling air upwardly through said grate and said material at higher temperature zones thereof.

2. The method according to claim 1 wherein said layer of material has zones of different depth and wherein said pulses of additional air pass through the zones of greater depth.

3. The method according to claim 2 wherein said pulses of additional air have a velocity sufficient to relayer the material at said greater depth zones.

4. The method according to claim 1 wherein said pulses of additional air have a velocity sufficient to relayer the material at said higher temperature zones.

5. The method according to claim 1 wherein said pulses of air issue from a plurality of nozzles aligned in a direction at right angles to the direction of movement of said material.

6. The method according to claim 1 including discontinuing the passing of said pulses of air through said material when the temperature of the higher temperature zones is reduced to a selected lower level.

7. Apparatus for cooling a moving layer of hot granular material supported on an air permeable grate, said material having zones at different temperatures, said apparatus comprising means for constantly passing cooling air upwardly through said grate and said material; and means for periodically passing pulses of additional cooling air upwardly through said grate and said material at higher temperature zones thereof.

8. Apparatus according to claim 7 wherein said layer of material has zones of different depth, and wherein said pulses of additional cooling air pass through the zones of greater depth.

9. Apparatus according to claim 8 wherein said pulses of additional cooling air have a velocity sufficient to relayer the material at said zones of greater depth.

10. Apparatus according to claim 7 wherein said pulses of additional cooling air have a velocity sufficient to relayer the material at said higher temperature zones.

11. Apparatus according to claim 7 wherein the means for passing said pulses of additional cooling air comprises a plurality of spaced apart nozzles.

12. Apparatus according to claim 11 wherein said nozzles are spaced from one another in a direction transversely of the direction of movement of said material.

13. Apparatus according to claim 7 including means for sensing the temperatures of a number of said zones, and control means responsive to sensing of a predetermined elevated temperature at least at one of said zones for activating the means for passing said pulses of additional cooling air through said grate and said material at said one of said zones.

14. Apparatus according to claim 13 wherein said control means comprises a solenoid valve.

15. Apparatus according to claim 7 wherein the means for constantly passing cooling air upwardly through said grate and said material comprises a plurality of separate cooling air chambers each of which has an air inlet in communication with air supply means and an outlet underlying a portion of said grate, said means for passing pulses of additional cooling air upwardly through said grate comprising a nozzle communicating with an air source and the inlet of one of said air chambers.

16. Apparatus according to claim 15 wherein said grate is comprised of a plurality of grate plates and wherein each of said grate plates is in communication with a separate one of said air chambers.

17. Apparatus according to claim 16 including control means for independently controlling the flow of air through each of said nozzles.

* * * * *